US008230647B2

(12) United States Patent
Cho et al.

(10) Patent No.: US 8,230,647 B2
(45) Date of Patent: Jul. 31, 2012

(54) DOOR ASSEMBLY FOR REFRIGERATOR

(75) Inventors: Suk Hyoun Cho, Gimhae-si (KR); Jeong Youl Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1305 days.

(21) Appl. No.: 11/417,265

(22) Filed: May 4, 2006

(65) Prior Publication Data

US 2006/0248824 A1 Nov. 9, 2006

(30) Foreign Application Priority Data

May 7, 2005 (KR) ..... 10-2005-0038236
May 23, 2005 (KR) ..... 10-2005-0042976
May 23, 2005 (KR) ..... 10-2005-0042977

(51) Int. Cl.
*F25D 23/02* (2006.01)

(52) U.S. Cl. ..... 49/501; 49/489.1; 52/784.13

(58) Field of Classification Search ..... 62/441; 312/406, 326

See application file for complete search history.

(56) References Cited

U.S. PATENT DOCUMENTS 2,114,880 A * 4/1938 King ..... 52/717.02
2,708,294 A * 5/1955 Saunders ..... 52/630
3,124,501 A * 3/1964 Wise ..... 52/DIG. 4
3,314,196 A 4/1967 Betz et al.
3,882,637 A * 5/1975 Lindenschmidt ..... 49/501
4,536,990 A * 8/1985 Siegrist et al. ..... 52/784.15
4,586,348 A * 5/1986 Nakayama et al. ..... 52/656.4
5,209,082 A * 5/1993 Ha ..... 62/441
5,359,795 A * 11/1994 Mawby et al. ..... 49/171

OTHER PUBLICATIONS

Mexican Office Action dated Jun. 13, 2011.

* cited by examiner

*Primary Examiner* — Mark Wendell
*Assistant Examiner* — Matthew J Smith
(74) *Attorney, Agent, or Firm* — KED & Associates LLP

(57) ABSTRACT

A door assembly for a refrigerator is provided which includes structure which is easily manufactured. The door assembly for a refrigerator door includes a door frame including a front panel and a flange unit formed on an edge of the front panel as one body therewith, a door liner mounted on the flange unit, and a filler provided within space formed between the door frame and the door liner.

19 Claims, 11 Drawing Sheets

DOOR ASSEMBLY FOR REFRIGERATOR

This application claims the benefit of the Patent Korean Application No. P2005-38236 filed on May 7, 2005, No. P2005-42976 filed on May 23, 2005 and No. P2005-42977 filed on May 23, 2005, which are hereby incorporated by reference as if fully set forth herein.

BACKGROUND OF THE INVENTION

1. Field of the Invention

The present invention relates to refrigerator, and more particularly, to a door assembly for a refrigerator.

2. Discussion of the Related Art

In general, a refrigerator is an electric appliance which can keep food fresh regardless of seasons.

For that, a conventional refrigerator is provided with a compressor, a condenser, a vaporizer and an expansion device to form a freezing cycle.

More specifically, a refrigerant passes through the compressor, the condenser, the expansion device and the vaporizer in order, and is phase-changed. Hence, the inside of the refrigerator may be maintained in a low temperature thereof by the phase-change of refrigerant.

Here, the refrigerator includes a refrigerator body defining an exterior thereof. The compressor, the condenser, the expansion device and the vaporizer are provided in the refrigerator body.

Also, at least one storage chamber is provided within the refrigerator body for preserving food therein. The inside of the storage chamber may be maintained in a low temperature by the vaporizer to preserve fresh the food kept in the storage chamber for a long time period.

At least one storage chamber is opened/closed by a door provided in front of the refrigerator body.

A filler is injected and hardened within the door to minimize the heat loss of the storage chamber inside, thereby performing a heat-insulating function.

However, in the process that the filler is injected and hardened within the door, the conventional refrigerator may have a problem that the filler may be leaked outside of the door.

Thus, demands for a door assembly for a refrigerator capable of preventing filler leakage have been increasing accordingly.

SUMMARY OF THE INVENTION

Accordingly, the present invention is directed to a door assembly for a refrigerator that substantially obviates one or more problems due to limitations and disadvantages of the related art.

An object of the present invention is to provide a door assembly with a structure easily manufactured and a refrigerator having the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door assembly for a refrigerator door includes a door frame comprising a front panel and a flange unit formed on an edge of the front panel as one body; a door liner mounted on the flange unit; and a filler provided within space formed between the door frame and the door liner.

Here, the flange unit is surrounding the edge of the front panel, and the door frame has a rear side opened.

The flange unit includes a bottom flange formed on a lower end of the front panel as one body; a top flange formed on an upper end of the front panel as one body; and a couple of side flanges formed on a right and left edge of the front panel as one body.

The door frame includes a reinforcement part provided in the front panel for reinforcing the door frame.

The reinforcement part is provided longitudinally on the front panel in a band shape.

Here, the reinforcement part comprises at least one of a reinforcing bead and a reinforcing rib.

More specifically, the reinforcement part further includes at least one vertical reinforcing protrusion provided on the front panel in a vertical direction; and a horizontal reinforcing protrusion provided on the front panel in a horizontal direction.

Moreover, the door frame further includes an external decorative member provided in front of the door frame.

At that time, the external decorative member is in close contact with the front panel, and the reinforcing part is projected forwardly from the front panel to elastically and uniformly support the rear surface of the external decorative member.

Meanwhile, the door frame further comprises at least one reinforcing groove provided on the edge of the front panel for reinforcing the door frame.

The at least one reinforcing groove is arranged along the right and left edge of the front panel.

At least one of the right and left edge of the front panel respectively comprises a chamfer.

Preferably, the door frame is molded with flexible resin.

The door assembly for a refrigerator according to the present invention further includes a sub-device coupled to the door frame.

The door frame includes a device installing part provided in the front panel of the door frame for having the sub-device insertedly installed therein; and an fastening part provided in the front panel of the door frame as one body with a fixing member for fixing the sub-device on the door frame fastened thereto, the fastening part projected backwardly in a predetermined distance from the front panel for not being passed through by the fastening member to prevent the filler from being leaked.

The flange unit comprises a liner mounting part curved at least twice as father backwardly to the door frame.

The liner mounting part is extended inwardly to the door frame, and then extended outwardly to the door frame in the opposite direction of the inward extension.

The liner mounting part and the door liner are mutually contacted twice.

Also, the door liner includes a projecting part projected toward the door frame, which is in contact with the curved portion of the liner mounting part, and the edge of the door liner is in line or plane contact with a rear surface of the liner mounting part.

The front panel of the door frame is supported by a lower jig and the filler is injected and hardened within space formed between the door frame and the door liner in a state where the door liner is pressed by an upper jig, such that the door frame and the door liner are coupled each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
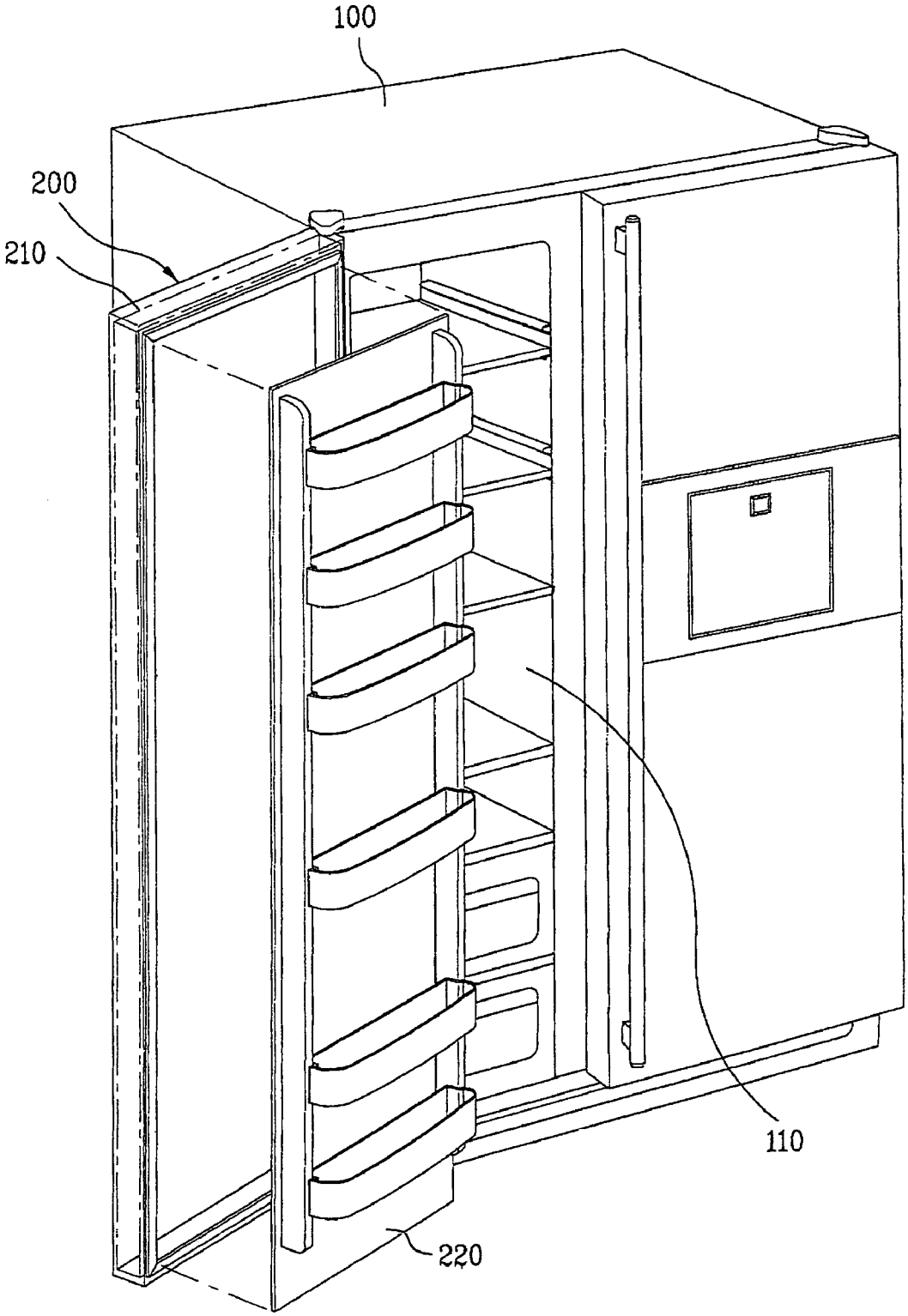
FIG. 1 is a perspective view illustrating an embodiment of a door assembly for a refrigerator according to the present invention.
Figure 2:
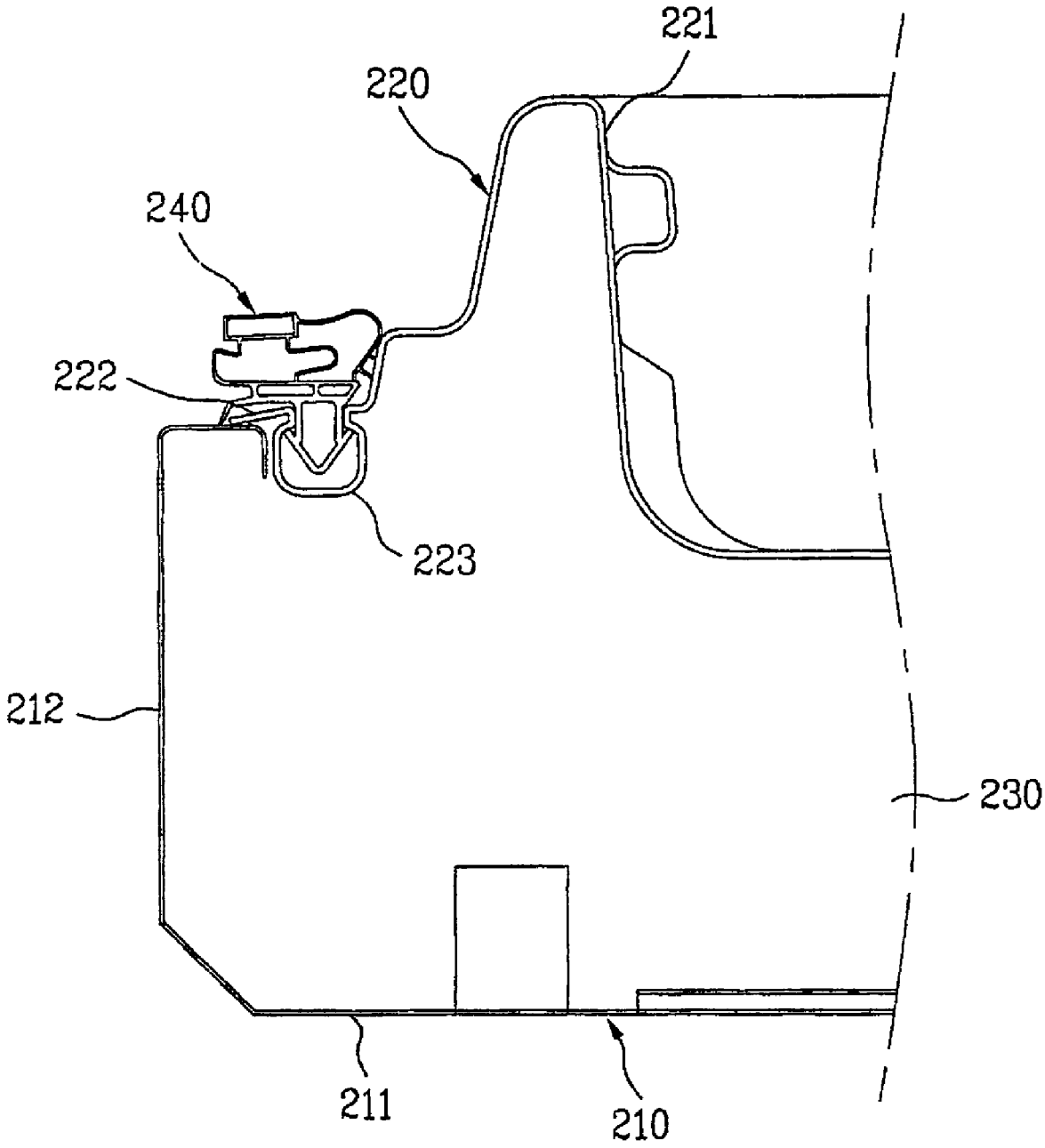
FIG. 2 is a sectional view partially illustrating the door assembly according to the present invention.

Referring to FIGS. 1 and 2, an embodiment of a door assembly according to the present invention and an embodiment of a refrigerator having the door assembly according to the present invention will be described.

As shown in FIGS. 1 and 2, the refrigerator according to the present invention includes a refrigerator body 100 and a door assembly 200.

More specifically, at least one storage chamber (not shown) is provided within the refrigerator body 100 for preserving food such as vegetables and fruits therein.

To put/take the food in/out of the storage chamber, a side of the refrigerator, more specifically a front side of the refrigerator body 100, is opened. The door assembly 200 is provided on the opened front side of the refrigerator body 100 to open/close the storage chamber 110.

Also, various types of shelves and drawers are installed within the storage chamber 110.

The door assembly 200 includes a door frame 210, a door liner 220 provided in rear of the door frame 210 and a filler injected into space formed by the door frame 210 and the door liner 220.

Here, the door frame 210 includes a front panel 211 and a flange unit 212 formed on an edge of the front panel 211 as one body.

The flange unit 212 of the door frame is formed on the front panel 211 as one body and surrounds the edge of the front panel 211, such that the rear side of the door frame may have opened appearance.

The flange unit 212 includes a bottom flange 212*a*, a top flange 212*b* and a couple of side flanges 212*c*.

The bottom flange 212*a* is formed on a lower end of the front panel 211 as one body, and the top flange 212*b* is formed on an upper end of the front panel 211 as one body. Also, the side flanges 212*c* are formed on a right edge and a left edge of the front panel as one body.

Particularly, the bottom flange 212*b* is extended backwardly from the lower end of the front panel 211, and the top flange 212*b* is extended backwardly from the upper end of the front panel 211. The couple of side flanges 212*c* are extended backwardly from opposite side ends of the front panel 211.

Thus, the bottom flange 212*a* defines a bottom of the door frame, and the top flange 212*b* defines an upper surface of the door frame. Also, the couple of side flanges 212*c* define a right and left surface of the door frame, respectively.

Preferably, the flange unit 212 is connected as one body. Thereby, the door frame 210 has a rear side thereof opened.

Moreover, the door frame 210 may include a reinforcement part 250 provided on the front panel 211 to reinforce the door frame.

Figure 3:
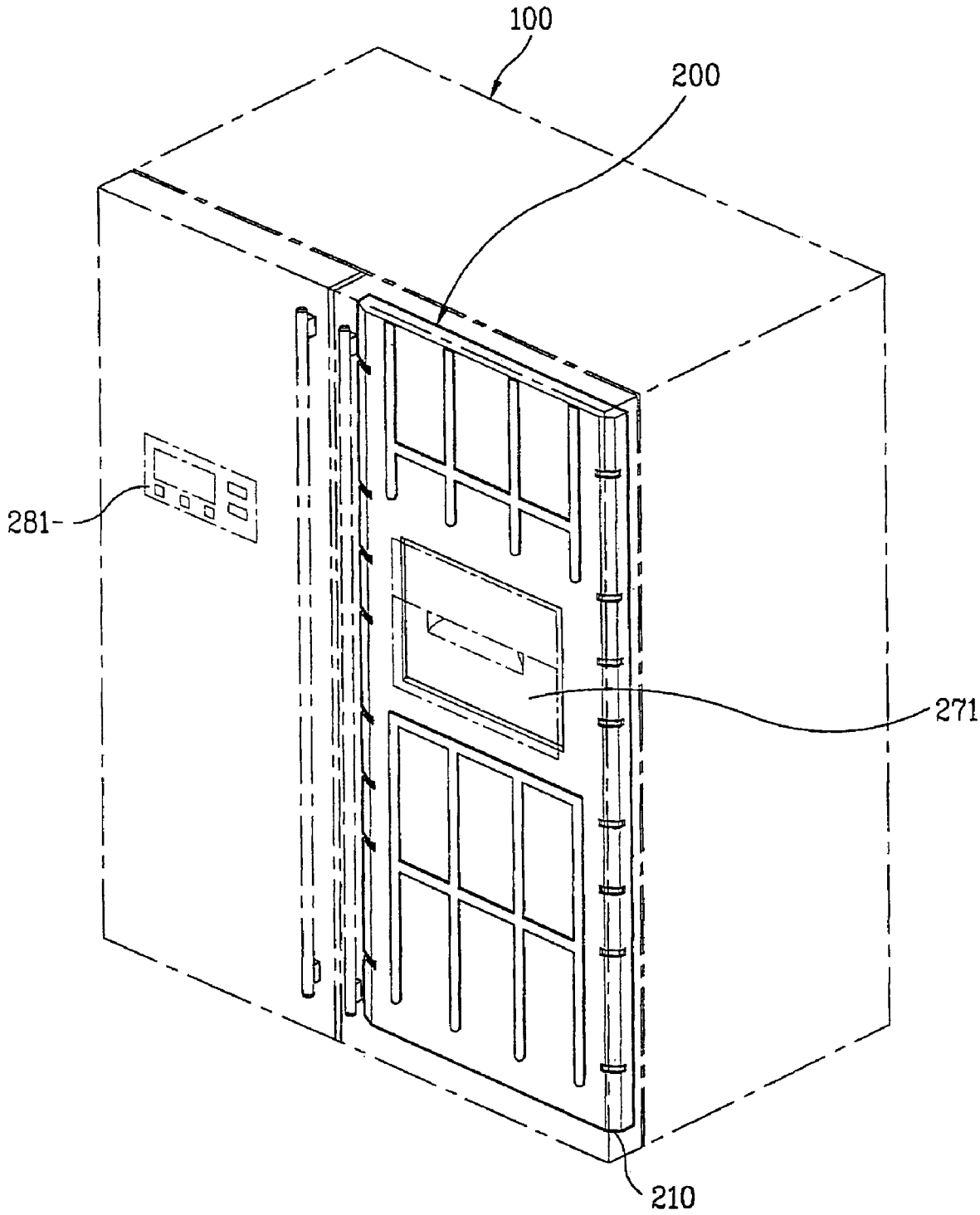
FIG. 3 is a perspective view illustrating an inside structure of the door assembly according to the present invention shown in FIG. 1.
Figure 4:
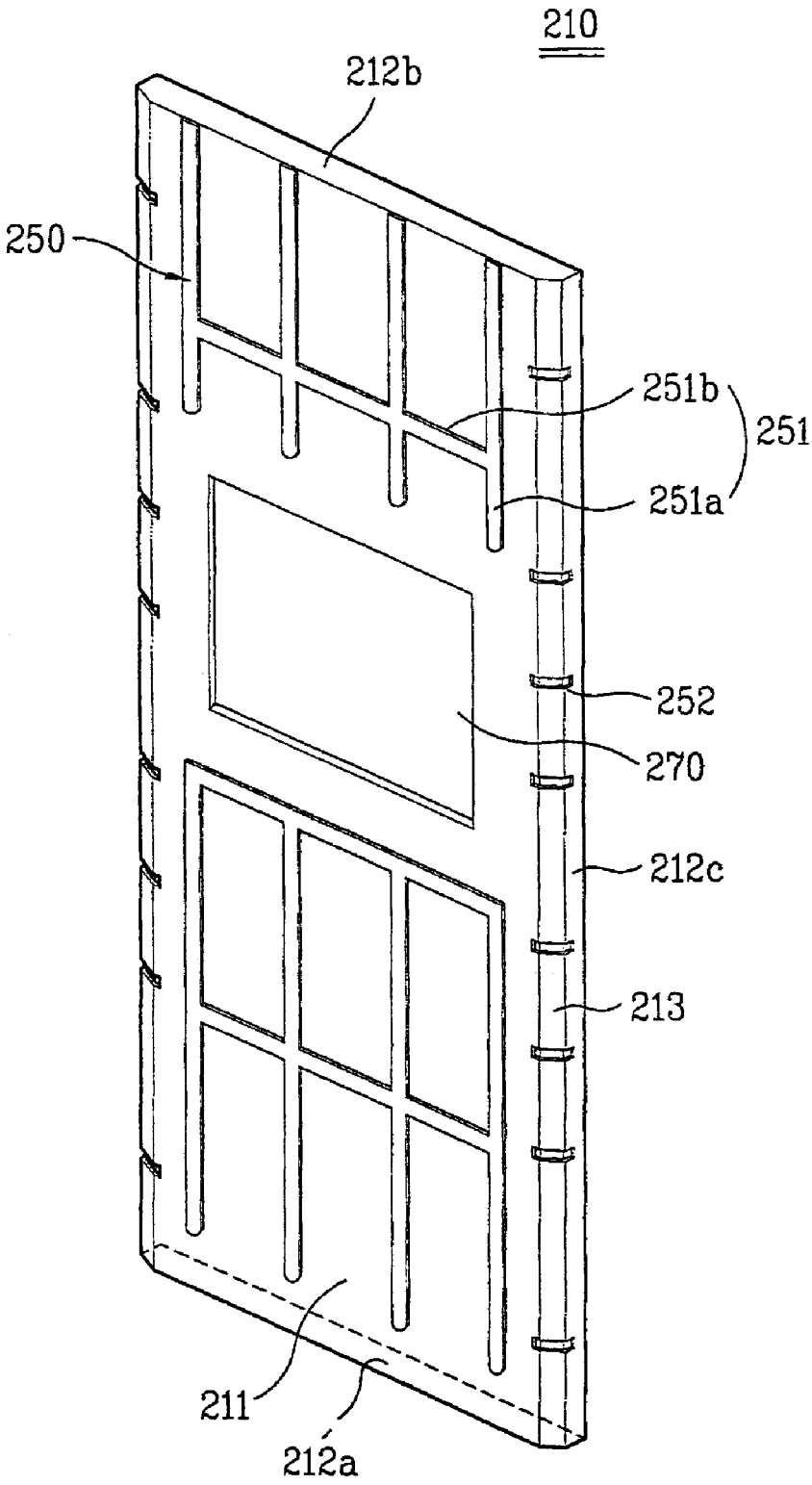
FIG. 4 is a perspective view of illustrating an embodiment of a door frame applied to the door assembly shown in FIG. 3.
Figure 5:
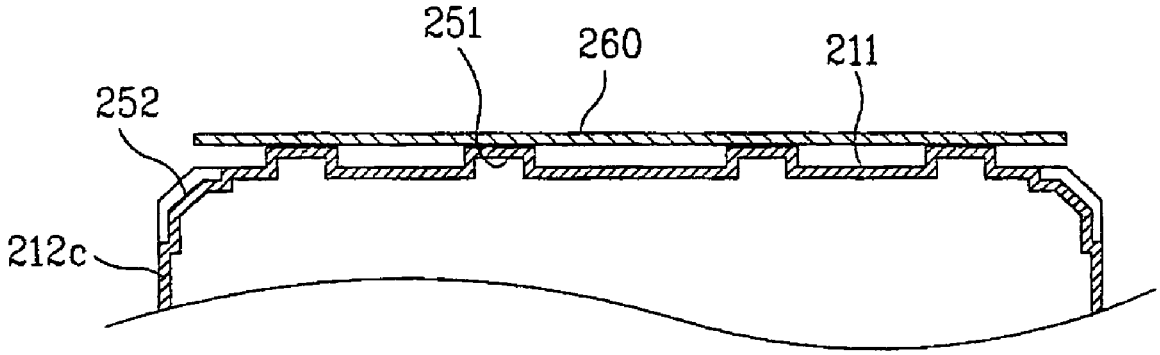
FIG. 5 is a sectional view illustrating a state where an external decorative member is mounted in front of the door frame shown in FIG. 4.

Referring to FIGS. 3 to 5, it is preferred that the reinforcement part 250 is provided on the front panel in a band shape.

More specifically, to reinforce the door frame 210 more efficiently, the reinforcement part 250 includes at least one reinforcing protrusion 251 longitudinally provided on the front panel 211.

The reinforcing protrusion 251 is projected forwardly or backwardly from the front panel 211.

The reinforcing protrusion 251 may be provided in a horizontal, vertical or diagonal direction of the front panel 211.

That is, the reinforcement part 250 may include a vertical reinforcing protrusion 251*a* and a horizontal reinforcing protrusion 251*b*. Alternatively, the vertical reinforcing protrusion 251*a* and the horizontal protrusion 251*b* may be diagonally crossed.

Plural vertical reinforcing protrusions 251*a* may be arranged on the front panel 211 in a horizontal direction, and plural horizontal reinforcing protrusions 251*b* may be arranged on the front panel 211 in a vertical direction.

For example, the reinforcement part 250 may include at least one of a reinforcing head and a reinforcing rib.

In other words, the reinforcing protrusion 251 may include the reinforcing head or the reinforcing rib.

According to this embodiment, the reinforcing protrusion 251 may be extrusion-molded to have a first side thereof recessed and a second side thereof projected, as shown in FIGS. 4 and 5.

According to the embodiment, the reinforcing protrusion 251 is projected forwardly from the front panel 211.

Meanwhile, the door frame 210 may further include at least one reinforcing groove 252 to reinforce the door frame 210.

The reinforcing groove 252 is provided on the edge of the door frame 210. More specifically, the at least one reinforcing groove 252 is arranged along the right edge and the left edge of the front panel 211.

According to the embodiment, plural reinforcing grooves 252 are longitudinally arranged on the right edge and the left edge of the front panel 211.

Here, it is preferred that the right and left edge of the front panel 211 have a chamfer 213, respectively.

The chamfer 213 has a predetermined angle from the front surface of the front panel 211, and connects the front surface of the front panel 211 and the side flanges 212*c*.

The reinforcing groove 252 is recessed on the right edge and left edge of the front panel 211, and then has an inner wall paralleled with the chamfer 213.

On the other hand, it is preferred that an external decorative member 260 is provided in front of the door frame 210.

The external decorative member 260 is attached to the reinforcement part 250, and the reinforcement part 250 is projected forwardly from the front panel 211 to uniformly support a rear surface of the external decorative member 260.

That is, since the reinforcement part 250 uniformly supports the rear surface of the external decorative member 260, the external decorative member 260 is prevented from being damaged. Also, the external decorative member 260 not only enhances the beauty of the front exterior of the door assembly 200, but also protects the door frame 210.

For that, preferably the reinforcing protrusions 251*a* and 251*b* are uniformly provided on the front panel 211 to support the external decorative member 260 in balance. For example, the reinforcing protrusions 251*a* and 251*b* may be arranged on the front panel 211 in a vertical or horizontal symmetry.

The external decorative member 260 may be formed in a one-body type or plural-plate type, such that the external decorative member 260 may form the entire front surface or some part of the front surface. Alternatively, the external decorative member 260 may be made of glass or acrylic.

The reinforcement part 250 and reinforcing grooves 252 may be provided in appropriate positions and in plural according to design conditions. Mainly, they may be provided in a portion where strength is weak or stress is concentrated.

Preferably, the door frame 210 is made of resin to facilitate the molding of the door frame 210 and the light weight of the door assembly 200.

The door frame 210 may be made by molding a resin sheet, or made by extrusion molding and vacuum molding. Thus, reinforcing protrusion 251*a* and 251*b* and the reinforcing groove 252 may be molded as one body with the front panel 211. However, the manufacturing method is not limited thereto.

Preferably, the door frame 210 is molded of a flexible resin sheet having elasticity so that the protrusion 251 may elastically support the external decorative member 260 and may prevent the damage of the external decorative member 260.

Furthermore, the door assembly 200 for a refrigerator according to the present invention may include a sub-device 271 and 281 mounted in the door frame 210.

For installing the sub-device 271 and 281, a device installing part 270 and 280 is provided in the front panel 211. Hence, the sub-device 271 and 281 is insertedly installed in the device installing part 270 and 280 and fixed by a fixing member.

The sub-device may include an operating part for operating a displayer or a refrigerator, a controlling part for controlling the displayer or the refrigerator, and an auxiliary door.

The device installing part 270 is provided in the front panel 211 and has a predetermined opening. The auxiliary door 271 may be installed in the device installing part 270 to open/close the opened device installing part.

The auxiliary door 271 is employed for minimizing the heat loss caused by the user opening the entire door assembly to put the food such as beverages in the storage chamber or take out the food out of the storage chamber.

Thus, the food put/taken out quite often may be put/taken out in/from through the device installing part 270 opened/closed by the auxiliary door 271. The auxiliary door 271 will be referred to as 'a home bar door' in the present invention.

In case that the displaying device, the operating part or the controller is installed in the door frame 210, the device installing part 280 may be recessed on the front panel.

Here, the appearance of the device installing part 280 is corresponding to that of the sub-device 281 insertedly installed in the device installing part 280.

The door liner 220 is mounted in the flange unit 212 formed on the edge of the front panel 211 as one body to form space having the filler 230 injected therein. Thus, the door liner 220 forms the inner wall of the door assembly 200.

Accordingly, since the door liner 220 is mounted in the flange unit 212, the inner space formed by the door liner and the door frame is made airtight. Thereby, the filler injected within the space may be prevented from being leaked.

More specifically, the edge of the door liner 220 is contacted with the flange unit 212 of the door frame 210 to shut off the inner space between the door liner 220 and the door frame 210. Thereby, the leakage of the filler injected into the space may be prevented.

Also, shelves (not shown) or baskets having a beverage bottles or food kept thereon may be provided in a rear surface of the door liner 220.

A dike 221 is projected backwardly in the door liner 220 to fix a basket.

Moreover, a packing member 240 such as a gasket is provided along the edge of the rear surface of the door liner 220 to prevent cooling air from being leaked into an aperture between the refrigerator body 100 and the door assembly 200 in a state where the door assembly 200 is closed.

A projecting part 223 having a recess recessed forwardly from the rear surface of the door liner 220 is provided in a portion adjacent to the door liner 220.

Meanwhile, in case that the home bar door is provided in the door frame 210, a shelf (not shown) for a home bar door may be provided in the door liner 220 to keep the beverages put/taken out quite often thereon.

The assembly process of the door assembly according to the embodiment of the present invention with the above configuration will be described.

First of all, the door liner 220 is mounted in the door frame 210. Hence, the edge of the door liner 220 is in contact with the flange unit 212 of the door frame 210.

That is, since the lower edge of the door liner 220 is contacted with the bottom flange 212*a* of the door frame 210, the upper edge of the door liner 220 is contacted with the top flange 212*b* of the door frame 210. Also, the opposite edges of the door liner 220 are contacted with the side flanges 212*c*.

Once the edge of the door liner 220 is in contact with the flange unit 212 as described above, space for the filler to be injected therein is formed by the door frame 210 and the door liner 220.

Hence, the filler 230 for insulation is injected and hardened within the space formed by the door frame 210 and the door liner 220. Then, the door assembly 200 may be insulating.

While injecting and hardening the filler 230, the filler 230 may be hardened between the door liner 220 and the door frame 210. Thereby, the door liner 220 may be fixed to the door frame 210. That is, the filler may be employed as adhesives.

Here, it is preferred that the filler 230 is injected in a state where the front panel 211 of the door frame 210 is supported by a lower jig and the door liner 220 is pressed by an upper jig in a predetermined pressure.

The sub-device 271 and 281 may be mounted in the door frame 210 before or after the injection of the filler 230.

The external decorative member 260 is made of a glass plate and provided in front of the front panel 211. Hence, the external decorative member 260 is attached to the front surface of the reinforcement part 250 having elasticity, thereby being uniformly and elastically supported. Also, the external decorative member 260 defines a front exterior of the door assembly 200.

The external decorative member 260 may be fastened by an auxiliary fixing member (not shown). A fastening recess is formed in the door frame 210, and a fastening projection is provided in the external decorative member 260. Thus, the external decorative member 260 may be fastened to the door frame 210.

The external decorative member 260 is fastened to the front surface of the front surface of the door frame 210 in a state where the door frame 210 and the door liner 220 are fastened.

Once the door assembly 200 is assembled-completely, the door assembly 200 is coupled to the refrigerator body 100 by a hinge (not shown) to open/close the storage chamber of the refrigerator.

The door assembly 200 having the above structure may be securely supported by the reinforcement part 250 and/or the reinforcing groove 252.

That is, the reinforcement part 250 and the reinforcing groove 252 reinforce the door frame 210 to prevent the door frame 210 from being damaged or deformed by the external force applied to the door frame 210.

More specifically, in case that the external force is applied to the door assembly 200, the reinforcing protrusion 251 in a band shape supports the front panel 211 in a vertical and a horizontal direction. Thereby, the damage and the deformity of the front panel 211 may be prevented.

In case that the external force is applied to the external decorative member 260 in a forward direction of the door assembly 200, the reinforcing protrusion 251 is elastically transformed to absorb the external force and to elastically support the rear surface of the external decorative member 260. Thus, the damage of the external decorative member 260 may be prevented by the shock absorbing action of the reinforcing protrusion 251*a* and 251*b*.

Also, door frame 210 may be elastically transformed and may absorb the shock against the external force, because the door frame 210 has elasticity itself.

Next, referring to FIGS. 6 to 8, another embodiment of the door assembly according to the present invention will be described.

Figure 6:
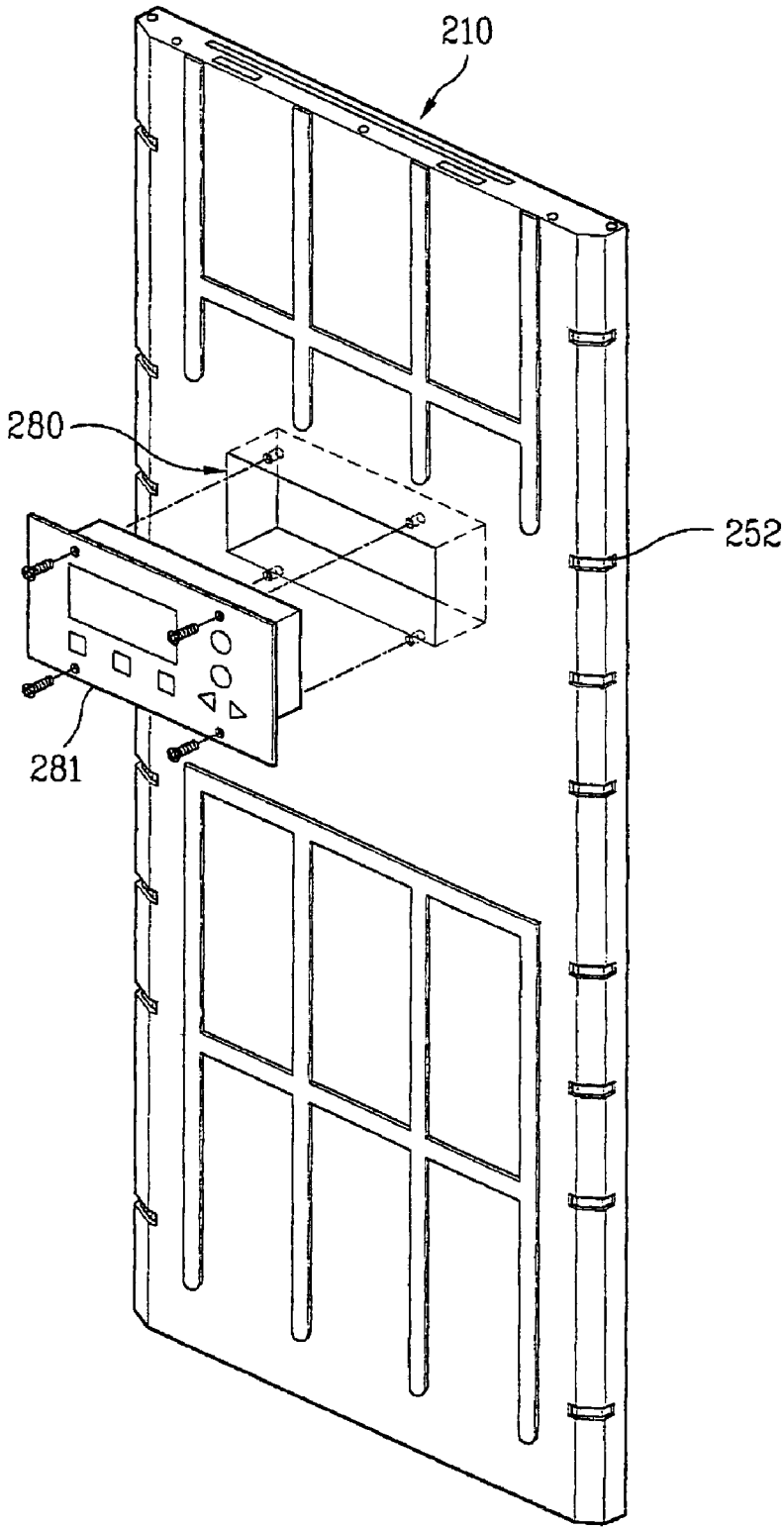
FIG. 6 is an exploded perspective view separately illustrating a door frame and a sub-device applied to another embodiment of a door assembly according to the present invention.
Figure 7:
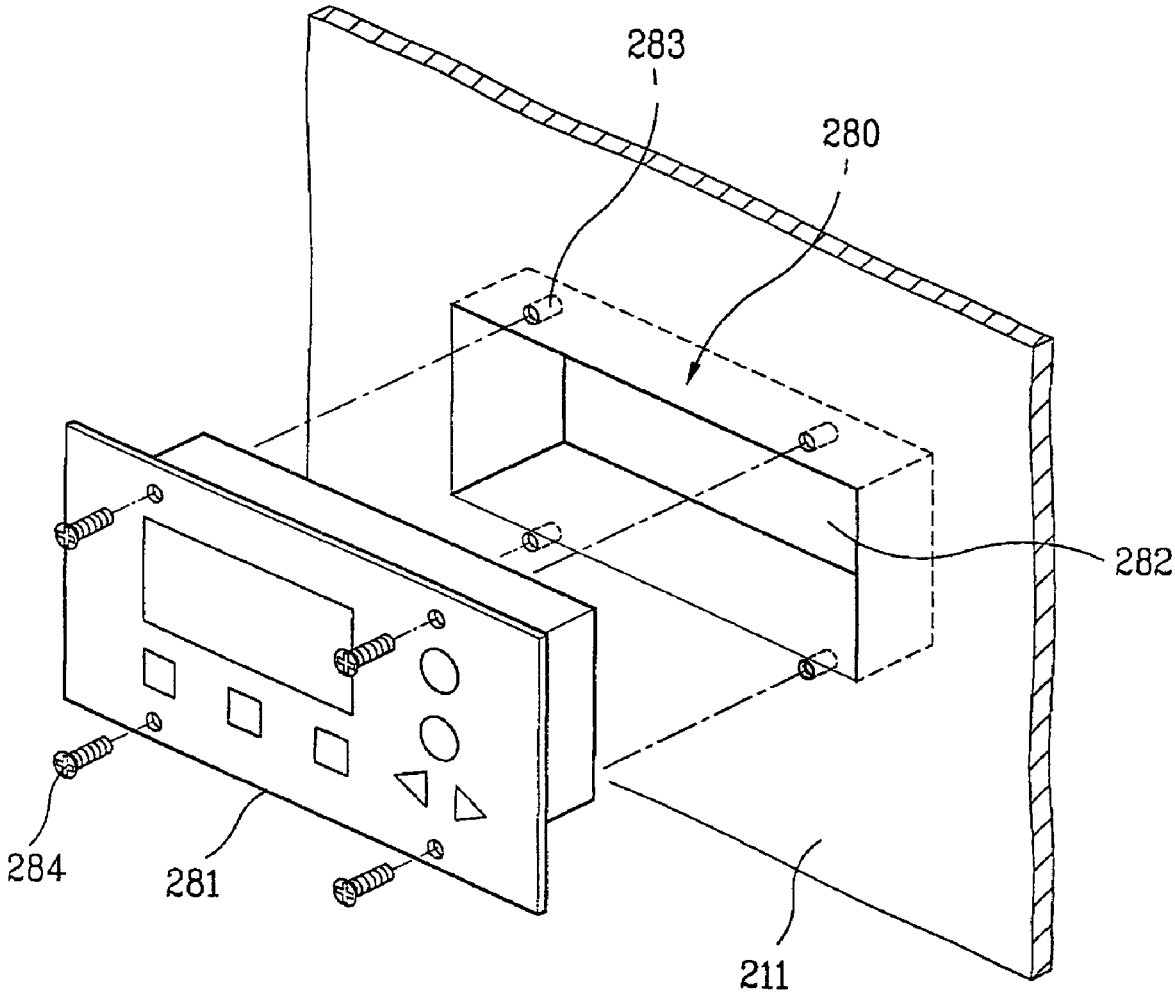
FIG. 7 is a diagram illustrating an assembling process of the door frame and the sub-device shown in FIG. 6.
Figure 8:
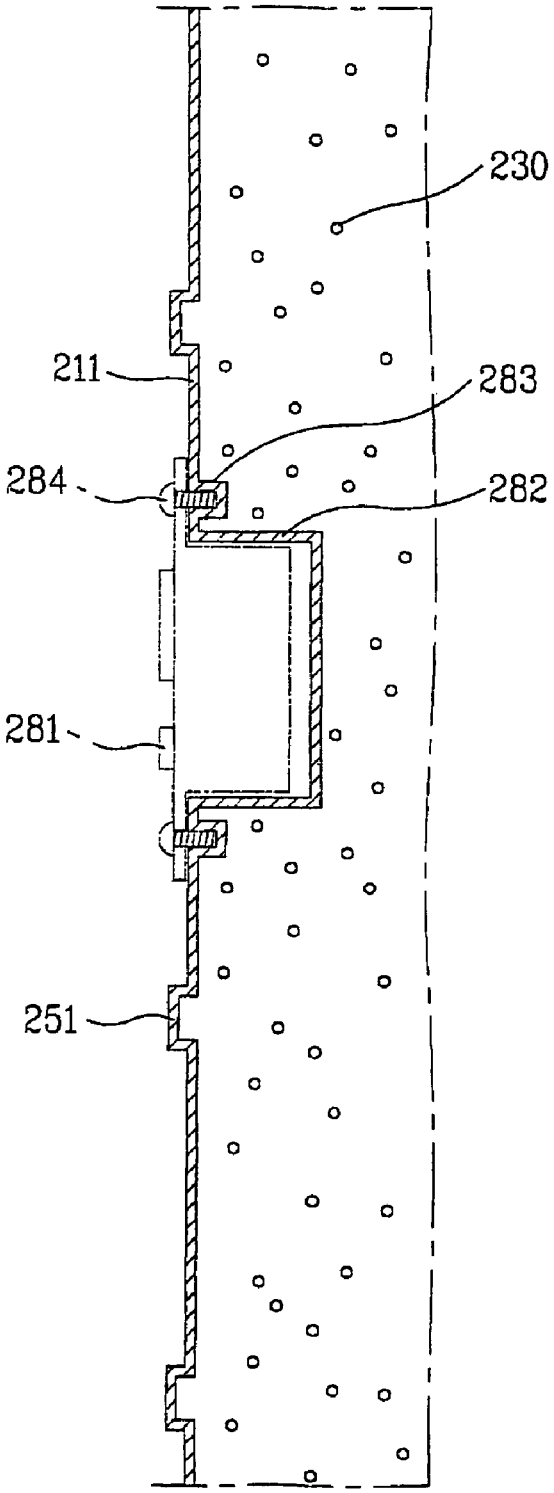
FIG. 8 is a sectional view partially illustrating the door assembly shown in FIG. 6.

As shown in FIGS. 6 to 8, another embodiment of the door assembly according to the present invention includes a door frame 210 and a sub-device 271 mounted in the door frame 210.

Here, the doorframe 210 includes a front panel 211 and a flange unit 212 formed on an edge of the front panel 211 as one body.

The sub-device 271 includes at least one of a displaying device, an operating part, a controller or a home bar door, as described before.

The displaying device may include a screen for displaying the operation conditions of the refrigerator or a displayer for being employed as a television, and furthermore include an inputting part of a touch screen type.

Alternatively, the sub-device 281 may include at least two of the displaying device, the operating part and the controller.

The door frame 210 may further include a device installing part 280 provided in the front panel 211 thereof to install the sub-device.

In case that the sub-device such as the displaying device, the operating part and/or the controller is installed in the door frame 210, the device installing part 280 includes a device installing recess 282 recessed backwardly from the front panel 211.

The sub-device 281 is inserted into the device installing recess 282.

Thus, preferably the appearance of the device installing recess 282 is corresponding to that of the sub-device 281 inserted therein and installed.

Meanwhile, since the device installing recess 282 is formed on the front panel 211 as one body, a rear surface of the device installing part 280 is projected backwardly.

Preferably, the device installing part 280 is formed as one body with the front panel 211 not to leak the filler 230, and has an airtight structure.

A fastening part 283 is provided in the front panel 211 for fastening the sub-device 281.

The fastening part 283 is formed in the front panel 211 as one body, and a fastening member 284 is fastened to the fastening part 283 to fix the sub-device 281 to the door frame 210.

The sub-device 281 may be secured to the front panel 211 by adhesives. It is preferred to use a fastening member such as a screw so as to fixedly secure the sub-device.

However, in case that the fastening member such as the above screw is used, the portion where the fastening member 284 is fastened may be passed through enough to cause a problem of the leakage of the filler.

Thus, it is preferred that the fastening part 283 is projected backwardly from the front panel 211 in a predetermined distance not to be passed through. Thereby, the leakage of the filler may be prevented.

More specifically, the fastening part 283 has a closed airtight structure, and has a fastening recess having a rear end closed. The rear end of the fastening recess 283 is provided in the portion projected backwardly from the rear surface of the front panel 211 in a predetermined distance.

Thereby, the filler 230 is not leaked from the device installing part 280 and the fastening part 283, although the filler 230 is injected into the space formed by the door frame 210 and the door liner 220.

The other configurations of the door assembly except the one described above are the same as the configurations of the door assembly according to the first embodiment of the present invention, thereby the detailed description thereof being omitted.

Figure 9:
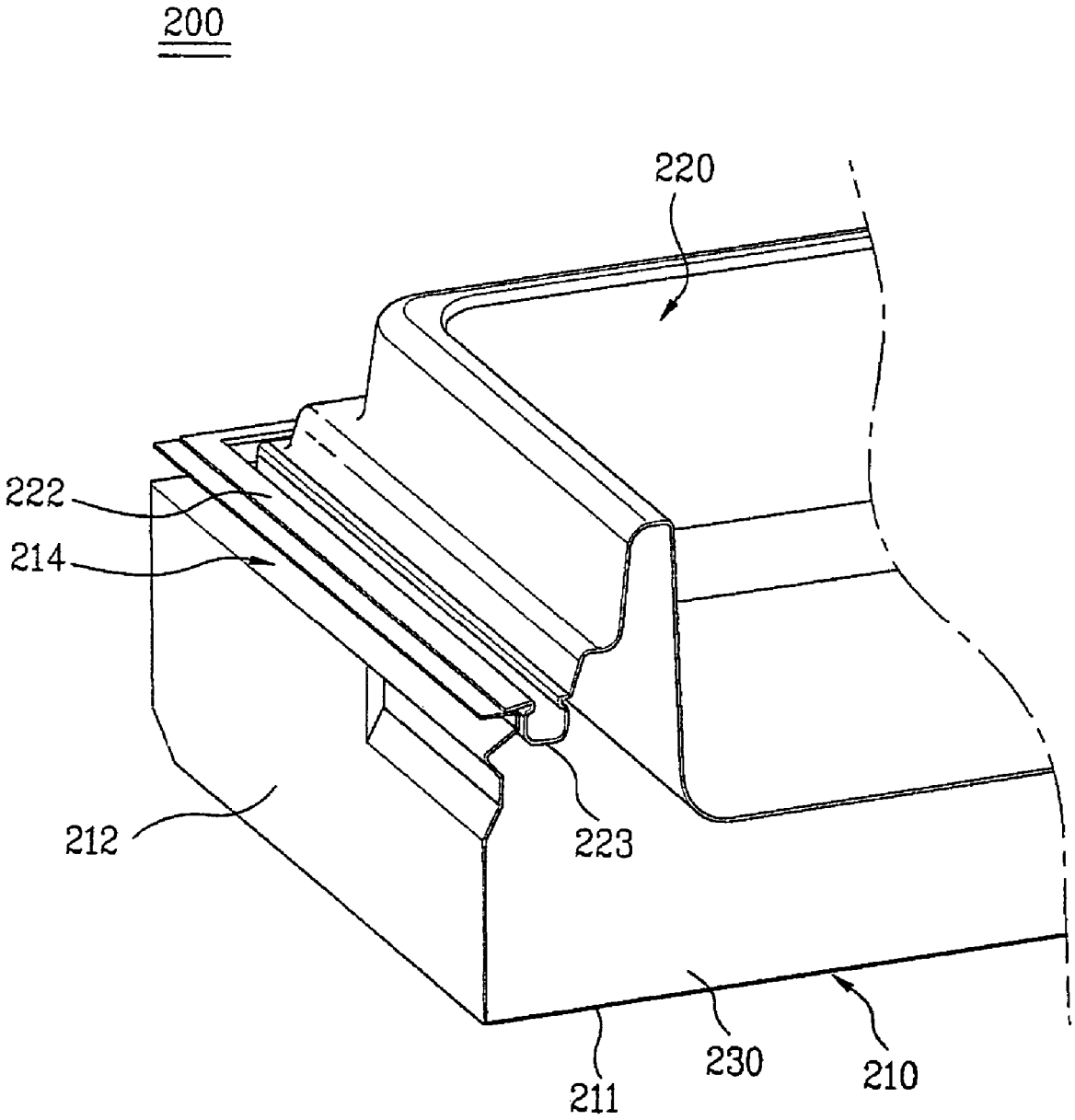
FIG. 9 is a cut-away perspective view illustrating still another embodiment of a door assembly according to the present invention.
Figure 10:
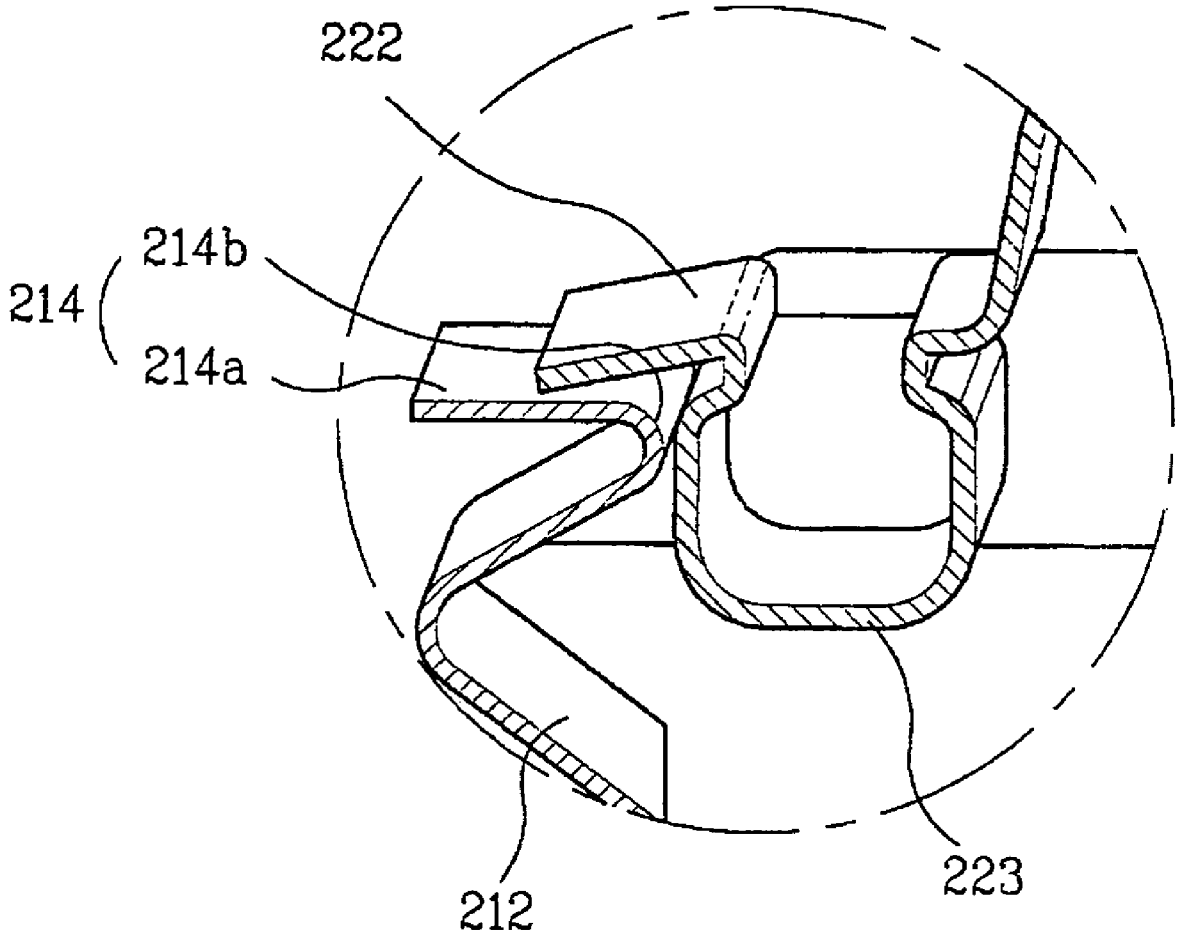
FIG. 10 is a cut-away perspective view enlargedly illustrating a portion where a door frame and a door liner shown in FIG. 9 are contacted each other.

Referring to FIGS. 9 and 10, still another embodiment of the door assembly according to the present invention will be described.

A door frame 210 provided in the door assembly 200 according to still another embodiment of the present invention includes a front panel 211 and a flange unit 212 formed on an edge of the front panel 211 as one body.

The flange unit 212 includes a liner mounting part 214 for having a door liner 220 mounted thereto.

Preferably, the liner mounting part 214 has a structure which can prevent a filler from being leaked through an aperture between the liner mounting part 214 and the door liner 220 while a filler being injected and/or injected and hardened.

According to this embodiment, the liner mounting part 214 is curved at least twice as farther backward from the door frame 210.

More specifically, the liner mounting part 214 is inwardly extended from the door frame 210, and after that, the liner mounting part 214 is outwardly extended from the door frame 210.

In other words, the liner mounting part 214 has a curved part 214*b* curvedly projected toward the parallel opposite flange part.

Thus, as the curved number of the liner mounting part 214 is increasing, the liner mounting part 214 actually may have a jig-jag appearance.

The liner mounting part 214 having the above appearance is provided on a rear end of the bottom flange 212*a*, the top flange 212*b* and the side flanges 212*c*, respectively.

Meanwhile, the liner mounting part 214 may be extended in an outward direction of the door frame 210 first, and then extended in an inward direction of the door frame 210 after changing the direction. In that case, the liner mounting part 214 may have a curved part recessed toward the paralleled opposite flange.

The door frame 210 having the above configurations may be made of metal material. Preferably, the door frame 210 is made of flexible resin having elasticity.

The door liner 220 is connected to the flange unit 212 of the door frame 210 to define an inner surface of the door assembly 200.

At that time, it is preferred that the liner mounting part 214 and the door liner 220 are mutually contacted twice.

That is, the door liner 220 has a projecting part 223 projected toward the door frame 210. And, the edge 222 of the door liner 220 is in line or plane contact with a rear surface 214*a* of the liner mounting part 214. The projecting part 223 of the door liner 220 is contacted with the curved part 214*b* of the liner mounting part 214.

Thus, once the door liner 220 is contacted with the door liner mounting part 214, space is formed by the door liner 220 and the door frame 210. Hence, the filler 230 is injected and hardened within the space, such that the door liner 220 and the door frame 210 are coupled each other.

The front panel 211 of the door frame 210 is supported by a lower jig (not shown), and the door liner 220 is put on the liner mounting part 214 of the door frame.

The filler 230 is injected and hardened within the space formed by the door frame 210 and the door liner 220 in a state where the door liner 220 is pressed by an upper jig (not shown). Thereby, the door frame 210 and the door liner 220 are coupled each other.

In the process where the filler 230 is injected and hardened, the leakage of the filler may be double-prevented in the curved part of the liner mounting part 214 as well as in the rear surface of the liner mounting part 214.

Figure 11A:
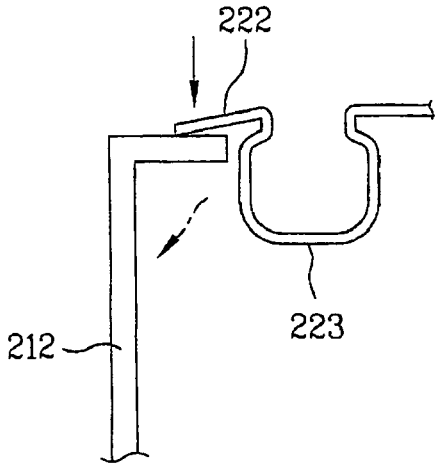
FIGS. 11A to 11C are sectional views partially illustrating a state where the door liner is mounted in a rear side of the flange unit.
Figure 11B:
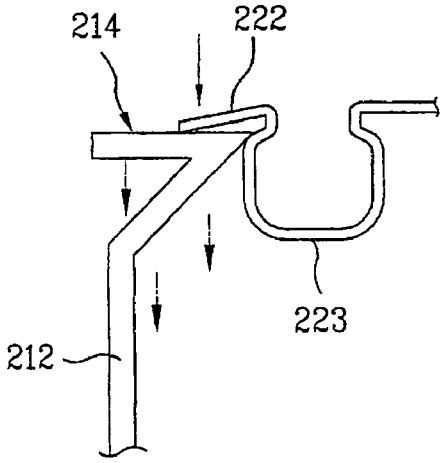
Figure 11C:
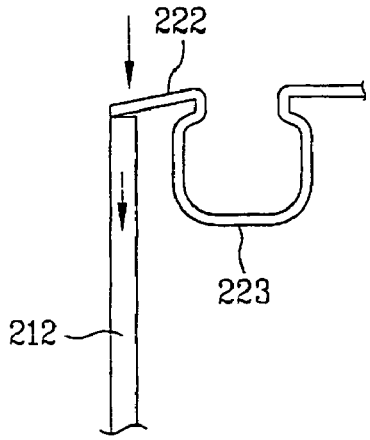

Compared with the appearance of the flange unit 212 shown in FIGS. 11A to 11C, the appearance of the flange unit 212 shown in FIG. 11*b* has more effective in preventing the leakage of the filler 230, because it increases the contacting section between the door liner 220 and the flange unit 212.

Meanwhile, since the other configurations of the door assembly except the configurations described above are the same as those of the embodiment and/or another embodiment, thereby the detailed description thereof being omitted.

The door assembly for the refrigerator according to the present invention has following advantageous effects.

Firstly, the door assembly for the refrigerator according to the present invention has an advantageous effect that manufacturing the door assembly may be facilitated, because the leakage of the filler for insulation is prevented.

Secondly, the door assembly for the refrigerator according to the present invention has another advantageous effect that the door frame thereof may have good elasticity to be easily changed and manufactured, because the door frame is made of resin.

Thirdly, the door assembly for the refrigerator according to the present invention has still another advantageous effect that the strength of the entire door assembly may be improved, because the reinforcement part and/or the reinforcing groove are/is formed on the door frame.

Fourthly, the door assembly for the refrigerator according to the present invention has still another advantageous effect that the damage of the external decorative member is prevented and the manufacture of the door assembly is facilitated, because the reinforcement part of the door frame elastically supports the external decorative member.

Fifthly, the door assembly for the refrigerator according to the present invention has still another advantageous effect that the leakage of the filler is prevented, because the device installing part for installing the sub-device and the fastening part for fastening the sub-device are made airtight.

Finally, the door assembly for the refrigerator according to the present invention has still another advantageous effect that the leakage of the filler is perfectly prevented, because the pressure applied when mounting the door liner is buffed by the liner mounting part having the curved appearance and the aperture between the door liner and the door frame is shut off twice by the liner mounting part.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A door assembly for a refrigerator, comprising:

a door frame comprising a front panel and a flange formed on an edge of the front panel as one body therewith;

a door liner mounted on the flange; and a filler provided within a space formed between the door frame and the door liner, wherein the flange comprises a liner mounting part that is curved at at least two locations, from the front panel, first outwardly away from the liner then inwardly towards the liner as the liner mounting part extends backward toward the door frame, wherein the door liner comprises a projecting part that projects toward the door frame and is adjacent to the flange, wherein the door frame comprises a reinforcement part provided in the front panel that reinforces the door frame, wherein the reinforcement part extends substantially longitudinally on the front panel in a band shape, and wherein the reinforcement part further comprises:

at least one vertical reinforcing protrusion provided on the front panel and extending in a substantially vertical direction; and a horizontal reinforcing protrusion provided on the front panel and extending in a substantially horizontal direction.

2. A door assembly for a refrigerator, comprising:

a door frame comprising a front panel and a flange formed on an edge of the front panel as one body therewith;

a door liner mounted on the flange; and a filler provided within a space formed between the door frame and the door liner, wherein the flange comprises a liner mounting part that is curved at at least two locations, from the front panel, first outwardly away from the liner then inwardly towards the liner as the liner mounting part extends backward toward the door frame, wherein the door liner comprises a projecting part that projects toward the door frame and is adjacent to the flange, wherein the door frame comprises a reinforcement part provided in the front panel that reinforces the door frame, wherein an external decorative member is provided in front of the door frame, wherein the external decorative member is adjacent to the front panel, and wherein the reinforcement part projects forwardly from the front panel so as to elastically and uniformly support a rear surface of the external decorative member.

3. The door assembly for a refrigerator of claim 2, wherein the door frame further comprises at least one reinforcing groove provided on an edge of the front panel that reinforces the door frame.

4. The door assembly for a refrigerator of claim 3, wherein the door frame includes at least two reinforcing grooves arranged along right and left edges of the front panel, respectively.

5. The door assembly for a refrigerator of claim 4, wherein at least one of the right edge or the left edge of the front panel comprises a chamfer.

6. The door assembly for a refrigerator of claim 2, wherein the door frame is molded with flexible resin.

7. The door assembly for a refrigerator of claim 2, further comprising a sub-device coupled to the door frame.

8. The door assembly for a refrigerator of claim 7, wherein the door frame comprises:

a device installing part provided in the front panel of the door frame that receives the sub-device insertedly installed therein; and a fastening part provided in the front panel of the door frame as one body, the fastening part coupled to a fixing member that fixes the sub-device on the door frame, the fastening part projecting backwardly a predetermined distance from the front panel, wherein fixing member does not pass through the fastening part, thereby preventing exposure of the filler.

9. The door assembly for a refrigerator of claim 2, wherein the filler is injected and hardened within the space formed between the door frame and the door liner and wherein the door liner is pressed to the front panel, such that the door frame and the door liner are coupled to each other.

10. The door assembly for a refrigerator of claim 2, wherein the flange surrounds the edge of the front panel, and wherein the door frame has an open rear side.

11. The door assembly for a refrigerator of claim 2, wherein the flange comprises:

a bottom flange formed on a lower end of the front panel as one body therewith;

a top flange formed on an upper end of the front panel as one body therewith; and a couple of side flanges formed on right and left edges of the front panel as one body therewith.

12. A door assembly for a refrigerator, comprising:

a door frame comprising a front panel and a flange formed on an edge of the front panel as one body therewith;

a door liner mounted on the flange;

a packing member coupled to a first end of the door liner;

a projecting part projecting toward the door frame and having a recess at the first end of the door liner recessed forwardly toward the door frame, the recess coupled to the packing member; and a filler provided within a space formed between the door frame and the door liner, wherein the flange comprises a liner mounting part that is in contact with the first end of the door liner and is adjacent to the projecting part, and wherein the projecting part is adjacent to the flange, wherein the liner mounting part extends inwardly with respect to the door frame, and then extends outwardly with respect to the door frame in the opposite direction of the inward extension, and wherein the liner mounting part and the door liner mutually contact at least twice.

13. The door assembly for a refrigerator of claim 12, wherein the projecting part is in contact with a curved portion of the liner mounting part, and wherein the edge of the door liner is in line or plane contact with a rear surface of the liner mounting part.

14. The door assembly for a refrigerator of claim 12, wherein the packing member includes a gasket.

15. The door assembly for a refrigerator of claim 12, wherein at least a portion of the packing member extends into the recess of the projecting part.

16. The door assembly for a refrigerator of claim 12, wherein the liner mounting part is curved at at least two locations as the liner mounting part extends backwardly toward the door frame.

17. The door assembly for a refrigerator of claim 12, wherein the liner mounting part contacts the first end of the door liner and the projecting part to form an airtight seal.

18. The door assembly for a refrigerator of claim 12, wherein:

the first end of the door liner has a first surface facing the door frame, and the liner mounting part has a second surface facing an interior space of the refrigerator, the first surface contacting the second surface.

19. The door assembly for a refrigerator of claim 18, wherein the first end of the door liner includes a first groove and the liner mounting part has a second groove, wherein the grooves face a same direction, and wherein the second groove is in contact with the first groove.

* * * * *